US009027655B2

(12) United States Patent
Xu et al.

(10) Patent No.: US 9,027,655 B2
(45) Date of Patent: May 12, 2015

(54) DEGRADABLE SLIP ELEMENT

(75) Inventors: Zhiyue Xu, Cypress, TX (US); Richard YingQing Xu, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 865 days.

(21) Appl. No.: 13/214,779

(22) Filed: Aug. 22, 2011

(65) Prior Publication Data

US 2013/0048305 A1 Feb. 28, 2013

(51) Int. Cl.
*E21B 29/00* (2006.01)
*E21B 23/01* (2006.01)

(52) U.S. Cl.
CPC ..... *E21B 23/01* (2013.01)

(58) Field of Classification Search
CPC ..... E21B 33/129; E21B 23/01; E21B 19/10; E21B 33/04
USPC ..... 166/376
See application file for complete search history.

(56) References Cited

U.S. PATENT DOCUMENTS

| | | | | |
|---|---|---|---|---|
| 5,984,007 | A | 11/1999 | Yuan et al. | |
| 6,167,963 | B1 | 1/2001 | McMahan et al. | |
| 7,168,494 | B2 | 1/2007 | Starr et al. | |
| 8,695,714 | B2 * | 4/2014 | Xu et al. | 166/376 |
| 2009/0065216 | A1 | 3/2009 | Frazier | |
| 2010/0089566 | A1 | 4/2010 | Swor et al. | |
| 2011/0048743 | A1 | 3/2011 | Stafford et al. | |
| 2011/0132620 | A1 * | 6/2011 | Agrawal et al. | 166/376 |

OTHER PUBLICATIONS

International Search Report and Written Opinion, Date of Mailing Jan. 14, 2013, International Application No. PCT/US2012/049441, International Search Report 6 pages; Written Opinion 4 pages.

Weatherford Packer Systems [online]; [retrieved on Nov. 7, 2011]; retrieved from the Internet http://www.weatherford.com/weatherford/groups/web/documents/weatherfordcorp/WFT002126.pdf. "HRP Hydraulic Retrievable Production Packer", Weatherford International Ltd., 2007, 2p.

* cited by examiner

*Primary Examiner* — Jennifer H Gay
*Assistant Examiner* — Caroline Butcher
(74) *Attorney, Agent, or Firm* — Cantor Colburn LLP

(57) ABSTRACT

A slip element, including a substrate at least partially formed from a material degradable upon exposure to a fluid; and an outer surface disposed on the substrate. A method of removing a slip element including exposing a substrate of the slip element to a downhole fluid for degrading the substrate.

18 Claims, 2 Drawing Sheets

DEGRADABLE SLIP ELEMENT

BACKGROUND

Slips are known in the downhole drilling and completions industry for anchoring components in a borehole. Slips are generally wedge-shaped devices that have teeth or other protrusions for "biting" into a tubular wall, typically a casing, as load is applied to the slips by components that are being anchored by the slips. When no longer needed, it is common to remove the components by milling or drilling operations. Current slip assemblies may include, e.g., a sleeve or series of segmented wedges made of cast iron or other materials that are difficult to remove by drilling or milling. The drilling/milling operations are time consuming and damaging to the bits used. Also, large chunks of cast iron or other materials often remain in the borehole after milling and are very difficult to fish out. As a result of the above, advances in slip assemblies are well received by the industry.

BRIEF DESCRIPTION

A slip element, including a substrate at least partially formed from a material degradable upon exposure to a fluid; and an outer surface disposed on the substrate.

A method of removing a slip element including exposing a substrate of the slip element to a downhole fluid for degrading the substrate.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
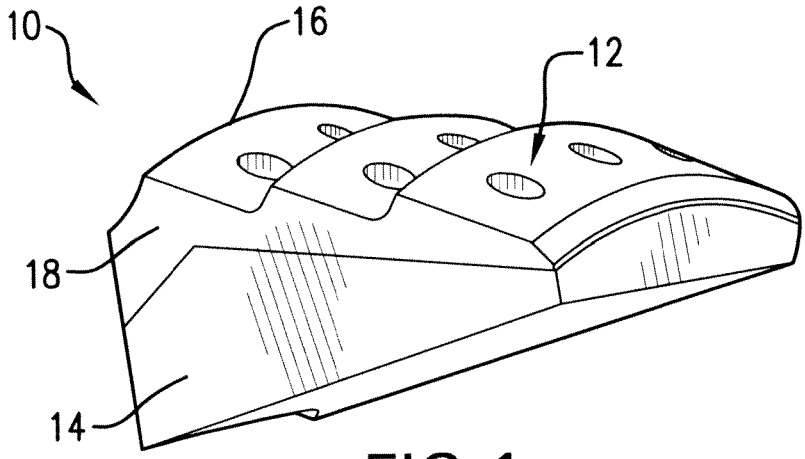
FIG. 1 is a perspective view of a slip element according to one embodiment described herein.

One embodiment of a slip element 10 is shown in FIG. 1. The slip element 10 includes an outer surface 12 on a substrate 14. A plurality of teeth 16 are formed at the outer surface 12. The teeth 16 extend from the slip element 10 to bite into a wall of a tubular, such as a well casing, for enabling the slip element 10 to anchor a string, tool, downhole component, etc., in place. For example, the element or an assembly in which the element is installed (see FIG. 2), may be wedge-shaped for engaging with a tubular wall in response to a load applied to the slip element or assembly.

In this embodiment, the substrate 14 is made from a first material or combination of materials that is degradable upon exposure to a fluid, while the outer surface 12 is made from a second material or combination of materials that may or may not be degradable upon exposure to the fluid, depending on the embodiment as discussed in more detail below. "Degradable" is intended to mean that the substrate 14 is disintegratable, dissolvable, weakenable, corrodible, consumable, or otherwise removable. It is to be understood that use herein of the term "degrade", or any of its forms, incorporates the stated meaning. The degradable material forming the substrate 14 and/or the outer surface 12 could be magnesium, aluminum, controlled electrolytic metallic materials, or other materials that are degradable in response to a downhole fluid. The downhole fluid could be acid, water, brine, or other fluids available or deliverable downhole. Controlled electrolytic metallic materials, described in more detail below, are particularly advantageous because, in addition to being controllably degradable, have good strength and toughness in comparison to other degradable materials. Further, the substrate 14 could be a combination of both degradable and nondegradable materials, which could be used, for example, to set certain properties of the substrate such as strength, toughness, degradation rate, etc.

In some embodiments, the outer surface 12 may be formed from the same degradable material as the substrate 14, a different degradable material than the substrate 14, a nondegradable material, a composite or composition including a nondegradable material and the degradable material of the substrate 14 or some other degradable material, etc.

In embodiments in which the outer surface 12 is formed from a different material than the substrate 14, a graded layer 18 may be included between the outer surface 12 and the substrate 14. The graded layer 18 is, e.g., a functionally graded material layer transitioning from the degradable material of the substrate to a composition having an increasingly high ratio of the material that forms the outer surface 12. For example, the graded layer 18 could terminate at the outer surface 12 as a composition of both the degradable material of the substrate and some other degradable or nondegradable materials.

Alternatively to the above, the outer surface 12 could be entirely formed from a nondegradable material. In another embodiment, there may be no graded layer 18 with the outer surface 12 instead formed from the same material as the substrate 14. In another embodiment, the entire slip element 10 could be formed as a graded layer, e.g., functionally graded material.

Methods of forming functionally graded materials are known in the art and can be used for forming the graded layer 18. These methods include bonding together layers having differing proportions of materials (e.g., different proportions of degradable and nondegradable materials) using sintering and pressing, cladding, laser 3D prototyping, diffusion brazing, etc. It is to be appreciated that the graded layer 18 could be of any desired thickness. For example, lasers can be used in cladding techniques or the like to bond a first material to a second material with a microscopic or metallurgical transition or graded layer.

The ability of the slip element 10 to anchor other components is at least partially dependent on the hardness of the outer surface 12 (i.e., the ability of the teeth 16 to bite into a tubular). Thus, in embodiments in which the outer surface 12 and the substrate 14 are formed from different materials, performance of the slip element 10 can be improved by selecting a material for the outer surface 12 that has a hardness suitable for biting into a tubular wall (typically a steel casing), that can also be milled, etc. For example, the outer surface could be formed at least partially from a ceramic, cermet, carbide, nitride, composite thereof, or other hard material bonded to the substrate 14. Of course, in some embodiments, the hardness of the material forming the substrate 14 may be sufficient and usable as the material for the outer surface 12, or the hardness of the substrate 14 could be increased by a surface hardening treatment or other modification to form the outer surface 12.

The speed at which the element 10 degrades from exposure to the downhole fluid is proportional to the percentage of the degradable material that is included in the exposed portion, the composition of the degradable material in the element 10, etc. Thus, the outer surface 12 can be arranged to degrade relatively slowly by selecting a degradable material with a slow degradation rate, forming the outer surface 12 as a combination of degradable and nondegradable materials with a low proportion of degradable material, etc. Exposure to the proper downhole fluid can thus be made to have little or no initial impact on the functioning of the slip element 10. In embodiments including the graded layer 18, the rate of degradation can also be set to increase as the percentage of the degradable material increases or the composition of the material changes in or proximate to the substrate 14. In this way, the outer surface 12 and/or the graded layer 18 can be used as a time-delay mechanism for slowing degradation of the slip element 10. That is, exposure of the slip element 10 to downhole fluids during normal use will result in significant degradation of the slip element 10 only after some predetermined amount of time. For this reason, it may be advantageous in some embodiments to include a relatively thick graded layer 18 or relatively highly resistant outer surface 12 for slowing down the rate of degradation of the slip element 10.

Figure 2:
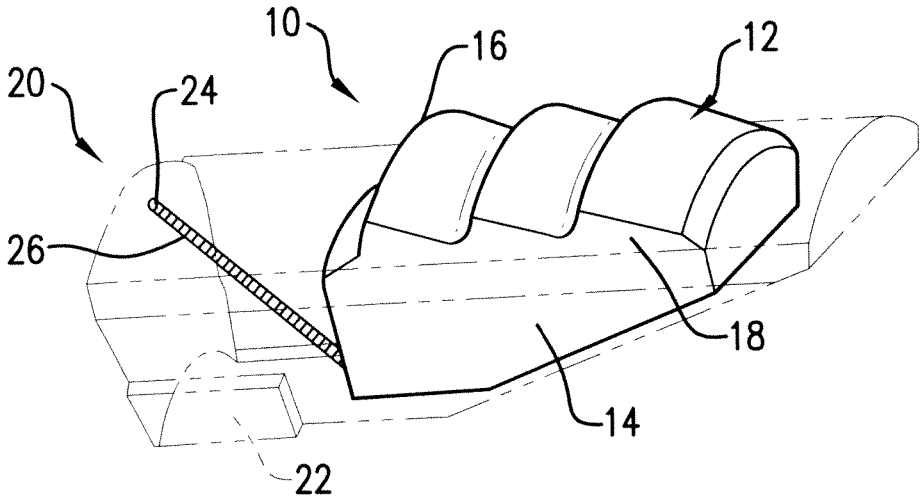
FIG. 2 is a perspective view of a slip assembly including the slip element of FIG. 1 protected by a molding.

In the embodiment of FIG. 2, a slip assembly 20 includes the slip element 10 disposed in a molding 22, which is shown partially transparent. The molding 22 is included to assist in installation of the slip elements 10 in a downhole assembly, initially protect the degradable substrate 14 of the slip element 10 from the downhole fluid, etc. The assembly 20 is installable in any suitable system, for example, as described in U.S. Pat. No. 6,167,963 (McMahan et al.), which patent is hereby incorporated by reference in its entirety. Furthermore, the slip assembly 20 is usable for purposes other than a bridge plug as described in McMahan et al., such as for a packer, whipstock, or any other component that needs to be anchored in a borehole. Additionally, the molding 22 could be a fiberglass reinforced phenolic material as disclosed in McMahan et al., or any other suitable material.

The molding 22 could be broken, cracked, or removed, for example, by a drilling or milling operation in order to expose the substrate 14 to the proper fluid. Especially if the molding 22 is made from a phenolic material, it will be relatively easy to remove by milling. Such a drilling or milling operation could be initiated to break, crack, or remove the molding 22 or a portion thereof, paused to enable the downhole fluids to degrade the substrate 14 for preventing undue wear on the milling equipment, then recommenced to remove any remaining nondegradable material. Alternatively, the milling or drilling operation could be commenced simultaneously with the degradation of the substrate 14, with any chunks of the element 10 that remain downhole continuing to degrade so that they do not have to be fished out later. In other embodiments, the molding 22 may have a passage that is openable upon actuation of a sleeve or other valve mechanism to trigger degradation.

Also illustrated in FIG. 2, a fluid channel 24 is included in the molding 22 and filled, packed, or blocked with a degradable material 26, e.g., in the form of a plug, blockage, etc. The material 26 degrades upon exposure to a fluid to open the channel 24 for enabling the fluid to reach and degrade the substrate material 14 without milling or drilling operation mentioned above. Thus, in embodiments in which the surface 12 is nondegradable, the rate of degradation of the material 26 can be selected to provide a time-delay function as described above, before the fluid reaches and degrades the substrate 14. Of course, any number of channels could be included in the molding and the channel or channels could take any size, shape, or orientation with respect to the molding. Furthermore, in embodiments in which the outer surface 12 is nondegradable, an area of the outer surface 12 could be left degradable, effectively creating a time-delay channel leading to the substrate 14.

Degradation of the substrate 14 could be triggered in other ways. For example, the outer surface 12 could be formed as a coating that is degradable upon exposure to the same fluid but at a slower rate (e.g., a composition of degradable and nondegradable materials as discussed above, some other material that is at least partially resistant to the downhole fluid, etc.), upon exposure to a different fluid, upon a certain temperature or other condition being reached, etc. Also, fluid communication could be enabled by actuation of a sleeve or valve mechanism, mechanical abrasion or removal of the outer surface 12 or molding 22, or any other mechanical or chemical means. Coatings forming the outer surface 12 or otherwise included to protect the substrate 14 could be applied by electroplating, plasma or laser techniques, etc.

Figure 3:
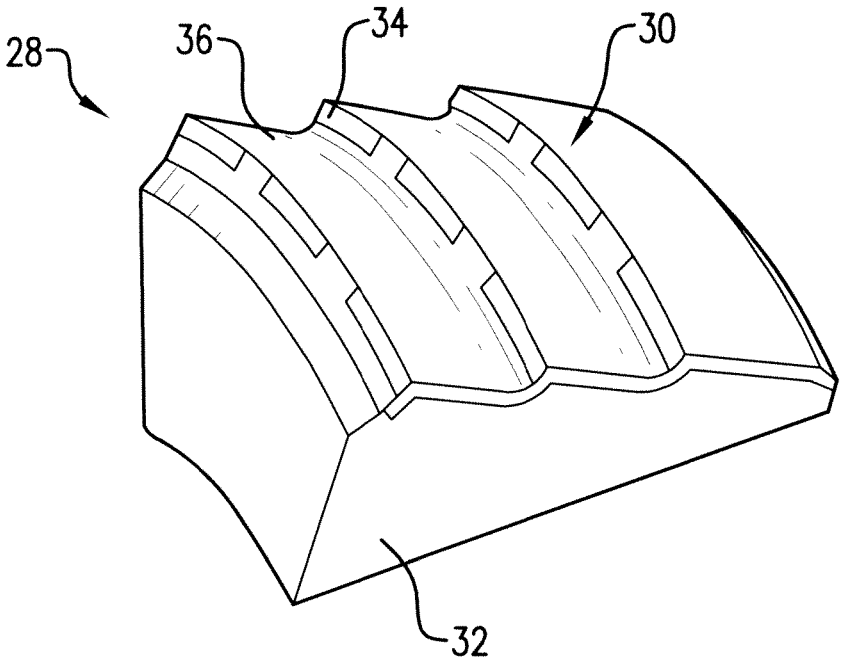
FIG. 3 is a perspective view of a slip element according to another embodiment described herein.

Another means for minimizing the amount of material that is left downhole is proposed in FIG. 3. In the embodiment of FIG. 3, a slip element 28 is shown substantially resembling the element 10, i.e., having an outer surface 30 and a degradable substrate 32. However, the slip element 28 has a plurality of biting elements 34 disposed at the outer surface 30 on each tooth 36. The biting elements 34 may be made of a hard material, such as a cermet, carbide, nitride, ceramic, composite, surface hardenable metal, etc., for enabling the aforementioned ability to bite into a wall of a tubular, although other materials could be used. In the embodiment of FIG. 3, the elements 34 take the form of plates, although the biting elements 34 could have other forms or be replaced by other members, e.g., plates with L-cross-sections disposed on the tips of the teeth 36, insertable buttons or other elements, etc. For example, see U.S. Pat. No. 5,984,007 (Yuan et al.), which patent is hereby incorporated by reference. Since the biting elements 34 provide the requisite hardness for anchoring the slip, the hardness of the nondegradable material forming the outer surface 30 is less important than in the embodiments discussed above. Thus, with respect to this embodiment, a wider variety of materials can be selected for the outer surface 30 (and/or the substrate 32), including those that might have been unsuitable for embodiments in which they would be required to bite into a tubular wall. For example, if the outer surface 30 and the substrate 32 are different materials, the outer surface 30 can be formed as a material that has better bonding capabilities with the degradable material of the substrate 32. The material forming the outer surface 30 can be nondegradable to the downhole fluid, act as a time-delay material, be formed as a coating, etc. Additionally, the elements 34 have a simpler geometry than the outer surface 30, and can therefore be manufactured more cheaply and easily from a variety of hard materials, including those that have relatively poor manufacturability.

Materials appropriate for the purpose of degradable substrates as described herein are lightweight, high-strength metallic materials. Examples of suitable materials, e.g., high strength controlled electrolytic metallic materials, and their methods of manufacture are given in United States Patent Publication No. 2011/0135953 (Xu, et al.), which Patent Publication is hereby incorporated by reference in its entirety. These lightweight, high-strength and selectably and controllably degradable materials include fully-dense, sintered powder compacts formed from coated powder materials that include various lightweight particle cores and core materials having various single layer and multilayer nanoscale coatings. These powder compacts are made from coated metallic powders that include various electrochemically-active (e.g., having relatively higher standard oxidation potentials) lightweight, high-strength particle cores and core materials, such as electrochemically active metals, that are dispersed within a cellular nanomatrix formed from the various nanoscale metallic coating layers of metallic coating materials, and are particularly useful in borehole applications. Suitable core materials include electrochemically active metals having a standard oxidation potential greater than or equal to that of Zn, including as Mg, Al, Mn or Zn or alloys or combinations thereof. For example, tertiary Mg—Al—X alloys may include, by weight, up to about 85% Mg, up to about 15% Al and up to about 5% X, where X is another material. The core material may also include a rare earth element such as Sc, Y, La, Ce, Pr, Nd or Er, or a combination of rare earth elements. In other embodiments, the materials could include other metals having a standard oxidation potential less than that of Zn. Also, suitable non-metallic materials include ceramics, glasses (e.g., hollow glass microspheres), carbon, metallic oxides, nitrides, carbides or a combination thereof. In one embodiment, the cellular nanomatrix has a substantially uniform average thickness between dispersed particles of about 50 nm to about 5000 nm. In one embodiment, the coating layers are formed from Al, Ni, W or $Al_2O_3$, or combinations thereof. In one embodiment, the coating is a multi-layer coating, for example, comprising a first Al layer, a $Al_2O_3$ layer, and a second Al layer. In some embodiments, the coating may have a thickness of about 25 nm to about 2500 nm.

These powder compacts provide a unique and advantageous combination of mechanical strength properties, such as compression and shear strength, low density and selectable and controllable corrosion properties, particularly rapid and controlled dissolution in various borehole fluids. The fluids may include any number of ionic fluids or highly polar fluids, such as those that contain various chlorides. Examples include fluids comprising potassium chloride (KCl), hydrochloric acid (HCl), calcium chloride ($CaCl_2$), calcium bromide ($CaBr_2$) or zinc bromide ($ZnBr_2$). For example, the particle core and coating layers of these powders may be selected to provide sintered powder compacts suitable for use as high strength engineered materials having a compressive strength and shear strength comparable to various other engineered materials, including carbon, stainless and alloy steels, but which also have a low density comparable to various polymers, elastomers, low-density porous ceramics and composite materials.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A slip element, comprising:

a substrate at least partially formed from a material degradable upon exposure to a fluid;

an outer surface disposed on the substrate, the outer surface having a hardness greater than a hardness of the substrate; and a functionally graded layer is disposed between the outer surface and the substrate, the functional graded layer being distinct from and having a composition different than the outer surface.

2. The slip element of claim 1, wherein the outer surface is formed at least partially from a different material than the substrate.

3. The slip element of claim 2, wherein the outer surface comprises a composition of degradable and nondegradable materials with respect to the fluid, the composition having a slower rate of degradation than the substrate.

4. The slip element of claim 2, wherein the outer surface consists solely of a nondegradable material and isolates the substrate from the fluid.

5. The slip element of claim 2, wherein the outer surface has a hardness greater than that of the substrate.

6. The slip element of claim 2, wherein the outer surface comprises at least one of a ceramic, a carbide, a nitride, a cermet, and a surface hardenable metal.

7. The slip element of claim 1, wherein the substrate comprises a controlled electrolytic metallic material.

8. The slip element of claim 1, further including at least one biting element disposed on or extending from the outer surface.

9. The slip element of claim 8, wherein the biting element is provided on at least one tooth of the slip element.

10. The slip element of claim 1, wherein the outer surface is formed by a coating.

11. A slip assembly comprising the slip element of claim 1 disposed in a molding.

12. The slip assembly of claim 11, wherein the molding is nondegradable with respect to the fluid and isolates the substrate from the fluid.

13. The slip assembly of claim 12, wherein at least one channel is formed extending through the molding to the substrate, the channel at least partially filled with the degradable material.

14. A method of removing a slip element comprising:

exposing a substrate of the slip element having an outer surface having a hardness greater than a hardness of the substrate and a functionally graded layer disposed between the substrate and the outer layer to a downhole fluid for degrading the substrate, the functionally graded layer being distinct from and having a composition different than the outer surface.

15. The method of claim 14, wherein the slip element is disposed in a molding, the molding being nondegradable upon exposure to the downhole fluid for initially isolating the substrate from the downhole fluid.

16. The method of claim 15, wherein exposing the substrate includes milling or drilling the molding.

17. The method of claim 14, wherein the outer surface is nondegradable upon exposure to the downhole fluid.

18. The method of claim 14, wherein the outer surface comprises a composition of degradable and nondegradable materials with respect to the fluid, and exposing the substrate includes first degrading the outer surface with the downhole fluid, wherein a degradation rate of the outer surface is slower than that of the substrate.

* * * * *